US010045682B2

(12) United States Patent
Gerstner et al.

(10) Patent No.: US 10,045,682 B2
(45) Date of Patent: Aug. 14, 2018

(54) LIFTING DEVICE AND DISHWASHER

(71) Applicant: BSH Hausgeräte GmbH, Munich (DE)

(72) Inventors: Norbert Gerstner, Herbrechtingen (DE); Thomas Steck, Dillingen (DE); Ralf Horsinka, Dischingen (DE)

(73) Assignee: BSH Hausgeräte GmbH, Munich (DE)

( * ) Notice: Subject to any disclaimer, the term of this patent is extended or adjusted under 35 U.S.C. 154(b) by 50 days.

(21) Appl. No.: 15/149,206

(22) Filed: May 9, 2016

(65) Prior Publication Data

US 2016/0331206 A1 Nov. 17, 2016

(30) Foreign Application Priority Data

May 11, 2015 (DE) ..... 10 2015 208 645

(51) Int. Cl.
*A47L 15/50* (2006.01)

(52) U.S. Cl.
CPC ..... *A47L 15/506* (2013.01)

(58) Field of Classification Search
CPC .... A47L 15/504; A47L 15/506; A47L 15/507; A47B 46/005; A47B 46/00; Y10S 414/13
USPC ..... 321/228.1
See application file for complete search history.

(56) References Cited

U.S. PATENT DOCUMENTS 2,919,966 A * 1/1960 Preston ..... A47B 21/02 126/337 A
3,195,969 A * 7/1965 Wallen ..... A47L 15/506 312/269
3,325,235 A * 6/1967 Lindstrom ..... A47L 15/506 312/269
3,794,400 A * 2/1974 Guth ..... A47B 77/10 312/269
5,115,822 A * 5/1992 Nichols ..... A47L 15/506 134/135
5,249,858 A * 10/1993 Nusser ..... A47B 46/005 312/248
5,462,347 A * 10/1995 Vogelgesang ..... A47B 46/005 312/247
5,971,513 A * 10/1999 Cassalia ..... A47L 15/506 312/272

(Continued)

FOREIGN PATENT DOCUMENTS

EP 0147815 A2 7/1985
WO 2015185631 A1 12/2015

OTHER PUBLICATIONS

National Search Report EP 16 16 6135 dated Aug. 4, 2016.
Report of Examination DE 10 2015 208 645.3 dated Jan. 26, 2016.

*Primary Examiner* — Patrick D Hawn
(74) *Attorney, Agent, or Firm* — Michael E. Tschupp; Andre Pallapies; Brandon G. Braun

(57) ABSTRACT

A lifting device for a holder for items to be washed in a dishwasher is configured to lift the holder for items to be washed from an initial position into an end position or lower it from the end position into the initial position. The lifting device includes a guide apparatus for guiding the holder in a horizontal direction. Arranged on the guide apparatus in a swivelable manner are a first swivel arm and a second swivel arm. A connecting element connects a first end section of the first swivel arm and a first end section of the second swivel arm, and is configured to couple a swivel movement of the first swivel arm and a swivel movement of the second swivel arm to one another in a positively driven manner.

11 Claims, 3 Drawing Sheets

(56) References Cited

U.S. PATENT DOCUMENTS

| | | | | |
|---|---|---|---|---|
| 6,247,771 | B1 * | 6/2001 | Miller | A47L 15/506 312/272 |
| 7,621,605 | B2 * | 11/2009 | Bond | A47B 46/00 312/311 |
| 7,731,805 | B2 * | 6/2010 | Banta | A47L 15/506 134/56 D |
| 9,004,622 | B2 * | 4/2015 | Garcia | A47B 46/005 312/228.1 |
| 9,420,882 | B2 * | 8/2016 | Garcia | A47B 46/005 |
| 2004/0163687 | A1 * | 8/2004 | Son | A47L 15/506 134/58 D |
| 2005/0206282 | A1 * | 9/2005 | Walburn | A47B 46/005 312/312 |
| 2006/0066189 | A1 * | 3/2006 | Bond | A47B 46/00 312/319.1 |
| 2007/0035220 | A1 * | 2/2007 | Bond | A47B 46/00 312/319.1 |
| 2008/0129168 | A1 * | 6/2008 | Banta | A47L 15/506 312/333 |
| 2012/0074080 | A1 | 3/2012 | Garcia et al. | |
| 2015/0002005 | A1 * | 1/2015 | Park | A47L 15/506 312/228.1 |
| 2015/0305493 | A1 * | 10/2015 | Garcia | A47B 46/005 211/86.01 |

* cited by examiner

LIFTING DEVICE AND DISHWASHER

CROSS-REFERENCES TO RELATED APPLICATIONS

This application claims the priority of German Patent Application, Serial No. DE 10 2015 208 645.3, filed May 11, 2015, pursuant to 35 U.S.C. 119(a)-(d), the disclosure of which are incorporated herein by reference in its entirety as if fully set forth herein.

BACKGROUND OF THE INVENTION

The present invention relates to a lifting device for a holder for items to be washed in a dishwasher and a dishwasher with a lifting device of this kind.

A dishwasher comprises a dishwasher cavity and at least one holder for items to be washed that can be moved into or moved out of the dishwasher cavity. The dishwasher can in particular comprise a plurality of holders for items to be washed arranged one on top of the other, such as for example a lower basket, an upper basket or a cutlery basket. Since the lower basket is arranged close to a floor of the dishwasher cavity, the user has to kneel down or bends toward the lower basket to load or unload the lower basket.

The publication DE 20 2009 004 771 U1 describes a lifting device for a lower basket in a dishwasher. The lifting device enables the lower basket to be moved from a lower position into an upper position and vice versa. The lifting device comprises swivel levers secured to a dishwasher cavity in the dishwasher in a swivelable manner and coupled to the lower basket. The swivel levers are connected centrally to a support strut.

BRIEF SUMMARY OF THE INVENTION

Against this background, it is an object of the present invention to provide an improved lifting device for a dishwasher cavity in a dishwasher.

Accordingly, a lifting device for a holder for items to be washed in a dishwasher is suggested wherein the lifting device is configured to lift the holder for items to be washed from an initial position into an end position or lower it from the end position into the initial position, wherein the lifting device includes a guide apparatus for the horizontal guidance of the holder for items to be washed, a first swivel arm arranged in a swivelable manner on the guide apparatus, a second swivel arm arranged in a swivelable manner on the guide apparatus and a connecting element connecting a first end section of the first swivel arm and a first end section of the second swivel arm, with the connecting element being configured to couple a swivel movement of the first swivel arm and a swivel movement of the second swivel arm to one another in a positively driven manner.

Since the first swivel arm is coupled to the second swivel arm by the connecting element in a positively driven manner, the lifting device is stabilized so that it is prevented from buckling in the end position even with high loading of the holder for items to be washed. The forced guidance further makes it possible to achieve a swivel angle of more than 90° between the swivel arms, which are preferably arranged parallel to one another, and the guide apparatus when the holder for items to be washed swivels out of the initial position and the end position. This enables a particular high elevation of the holder for items to be washed to be achieved. The holder for items to be washed is preferably a lower basket in the dishwasher.

According to another advantageous feature of the present invention, the first end sections of the swivel arms face away from the guide apparatus.

According to one embodiment, the first swivel arm and the second swivel arm have each a second end section, wherein the second end sections of the first and the second swivel arms can be arranged in a swivelable manner on the guide apparatus.

Provision may be made for a bearing on each of the second end sections of the swivel arms, with the bearings being used to support the swivel arms in a swivelable manner on the guide apparatus. The guide apparatus is advantageously a so-called telescopic rail. The guide apparatus may include a first guide rail, a second guide rail and a third guide rail arranged between the first guide rail and the second guide rail. The second end sections of the lever arms can be connected to the second guide rail in a swivelable manner. The holder for items to be washed can be attached to the first guide rail. The swivel arms may be configured in particular strip-shaped or strut-shaped.

According to a further embodiment, the first end sections of the swivel arms can be connected to a dishwasher cavity in the dishwasher in a swivelable manner.

Bearings, in particular fixed bearings, can be provided on the first end sections. The bearings of the first end sections can advantageously be permanently connected to the dishwasher cavity. For example, the bearings can be riveted, welded, clipped or screwed to the dishwasher cavity.

According to a further embodiment, the connecting element can be connected in a swivelable manner to the first end section of the first swivel arm and the first end section of the second swivel arm.

To this end, bearings can be provided on the second end sections, respectively. The connecting element can be riveted, screwed or clipped to the bearings.

According to a further embodiment, the connecting element can be a strut.

The connecting element may in particular be bar-shaped or strip-shaped. The connecting element is configured to transmit compressive forces or transverse forces.

According to a further embodiment, the first end section of the first swivel arm and the first end section of the second swivel arm can each include a lever arm, with the connecting element connecting the lever arms to one another.

Advantageously, the respective lever arms can be embodied as materially integral with the swivel arms assigned thereto. The lever arms may extend laterally from the swivel arms. For example, the swivel arms with the lever arms can each be embodied as bent sheet metal components and/or stamped components.

According to a further embodiment, each lever arm can be arranged at an angle of inclination relative to the swivel arm assigned thereto.

Advantageously, the angles of inclination between the lever arm of the first swivel arm and the first swivel arm and between the lever arm of the second swivel arm and the second lever arm are the same. The lever arms may, advantageously point in the direction of the second end sections of the swivel arms. The two lever arms can point in the same direction. The angle of inclination can for example be 10° to 80°, preferably 20° to 70°, further preferably 30° to 60°, further preferably 40° to 50°.

According to a further embodiment, each swivel arm can form a V-shaped or L-shaped geometry with the lever arm assigned thereto.

The bearings of the first end sections of the swivel arms can be arranged on a tip of the V-shaped geometry. The lever arm forms a short limb and the respective swivel arm forms a long limb of the geometry.

Also suggested is a dishwasher with a holder for items to be washed and a lifting device as described above.

The dishwasher can be a domestic dishwasher. The holder for items to be washed is preferably a lower basket in the dishwasher. The dishwasher can furthermore include an upper basket arranged above the lower basket and a cutlery drawer arranged above the upper basket.

According to a further embodiment, the dishwasher can include two lifting devices which are arranged on opposite side walls of a dishwasher cavity in the dishwasher.

The holder for items to be washed can be arranged between the lifting devices and suspended therein. In particular, the holder for items to be washed can be suspended in the two lifting devices simultaneously.

Further possible implementations of the lifting device and/or the dishwasher also involve non-explicitly named combinations of features or embodiments described above or below with respect to the exemplary embodiments. At the same time, the person skilled in the art will also add individual aspects as improvements or supplements to the respective basic embodiment of the lifting device and/or dishwasher.

BRIEF DESCRIPTION OF THE DRAWINGS

Further advantageous embodiments and aspects of the lifting device and/or the dishwasher are the subject matter of the subclaims and the exemplary embodiments of the lifting device and/or the dishwasher described below. The following describes the lifting device and/or the dishwasher with reference to preferred embodiments and with reference to the attached figures, which show FIG. 1 a schematic side view of an embodiment of a dishwasher;

DETAILED DESCRIPTION OF EXEMPLARY EMBODIMENTS OF THE PRESENT INVENTION

Figure 1:
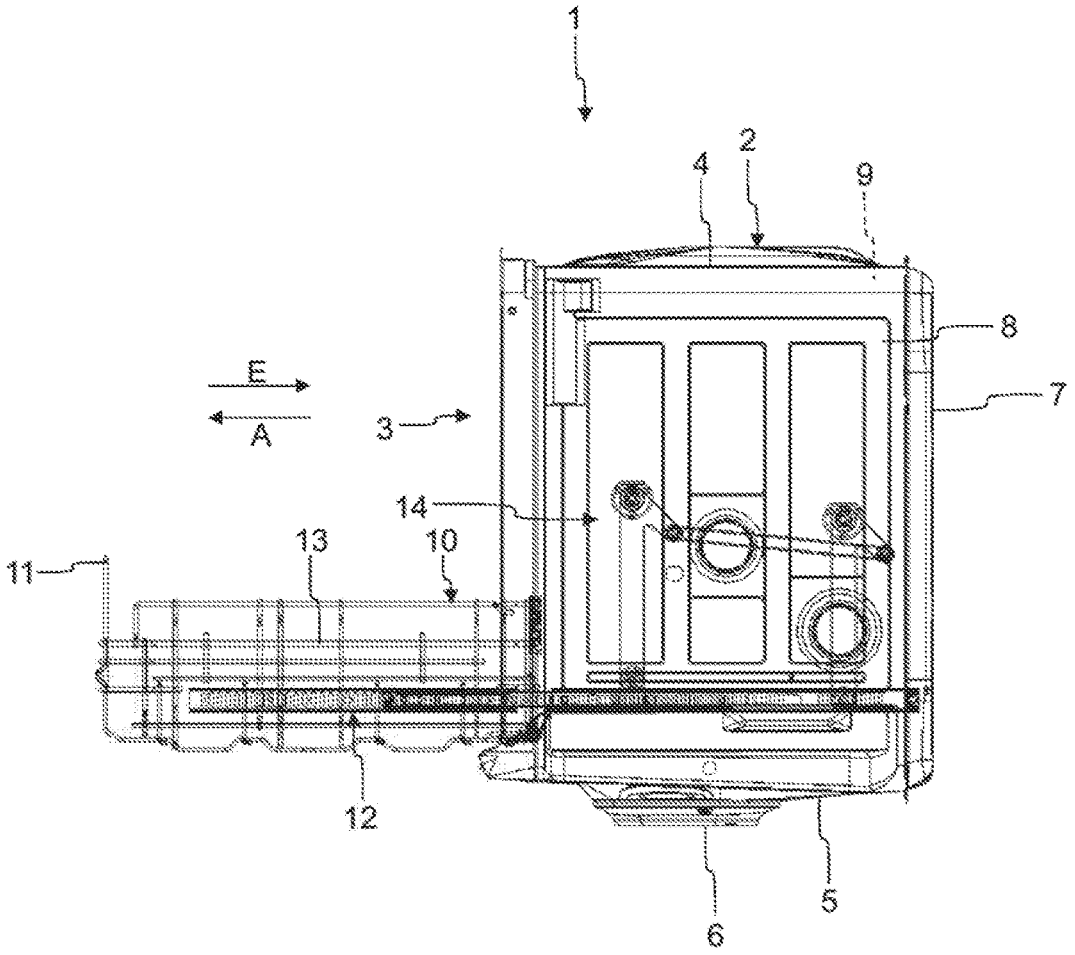

Unless specified otherwise, identical or functionally identical elements are assigned the same reference characters in the figures.

Figure 2:
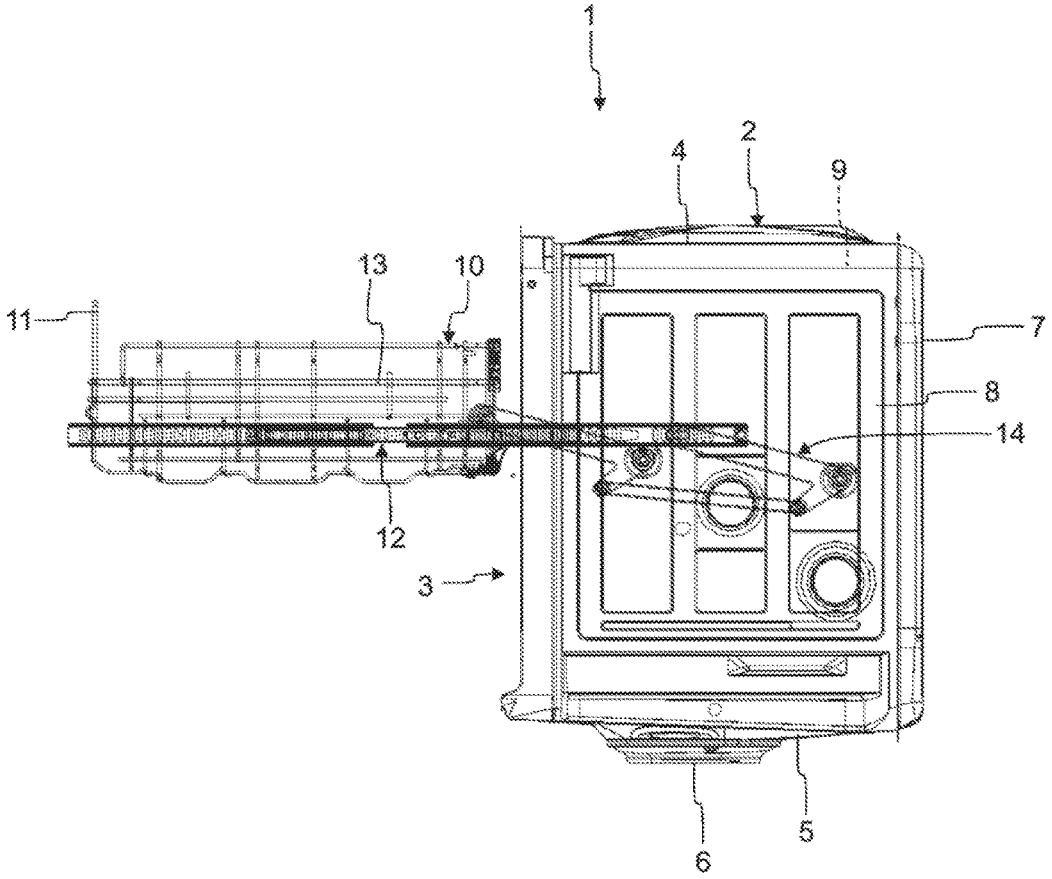
FIG. 2 a further schematic side view in the dishwasher according to FIG. 1.

FIG. 1 is a schematic side view of an embodiment of a dishwasher 1. FIG. 2 is a further schematic side view of the dishwasher 1. Hereinafter, reference will be made to FIG. 1 and FIG. 2 simultaneously.

The dishwasher 1 is in particular a domestic dishwasher. The dishwasher 1 comprises a dishwasher cavity 2. The dishwasher cavity 2 in particular has a rectangular shape. The dishwasher cavity 2 is preferably made of sheet steel. Alternatively, the dishwasher cavity 2 can be produced at least partially from a plastic material. The dishwasher cavity 2 has a loading aperture 3 on the front side, which can be closed in a water-tight manner with a door that is shown in FIG. 1 and not shown in FIG. 2. To this end, a sealing apparatus can be provided between the door and the dishwasher cavity 2.

The dishwasher cavity 2 comprises a top 4, a floor 5 arranged opposite to the top 4 on which a pump sump 6 can be provided, a rear wall 7 arranged opposite to the loading aperture 3 and two side walls 8, 9 arranged opposite to one another. The dishwasher 1 further comprises at least one holder for items to be washed 10. The holder for items to be washed 10 is basket-shaped. The holder for items to be washed 10 is preferably a lower holder for items to be washed or a lower basket in the dishwasher 1. The holder for items to be washed 10 comprises a handle 11 on the front side. The dishwasher 1 further comprises an upper holder for items to be washed or an upper basket and a cutlery drawer. The cutlery drawer is arranged above the upper holder for items to be washed.

The holder for items to be washed 10 can be pulled out of the dishwasher cavity 2 in a direction of extraction A and pushed into the dishwasher cavity 2 against the direction of extraction A in a direction of insertion E. To this end, the holder for items to be washed 10 is guided in the dishwasher cavity 2 by means of a guide apparatus 12. The guide apparatus 12 can be a so-called telescopic rail. The holder for items to be washed 10 is made of wires 13, which can be suspended in the guide apparatus 12. This enables the holder for items to be washed 10 to be removed from the guide apparatus 12. A guide apparatus 12 of this kind is preferably provided on both sides of the holder for items to be washed 10.

The dishwasher 1 further comprises a lifting device 14, which is configured to lift the holder for items to be washed 10 from an initial position shown in FIG. 1 into an end position shown in FIG. 2 or lower it from the end position into the initial position. In the initial position shown in FIG. 1, the holder for items to be washed 10 is pulled out of the dishwasher cavity 2 by means of the guide apparatus 12 in the direction of extraction A. In the end position, the holder for items to be washed 10 is lifted by means of the lifting device 14 to approximately the height of the (not shown) upper holder for items to be washed so that a user does not have to bend toward this in order to load and unload the holder for items to be washed 10. The dishwasher 1 preferably comprises two such lifting devices 14 arranged on the opposite side walls 8, 9 of the dishwasher cavity 2. However, the following will only refer to one lifting device 14. The lifting device 14 can comprise a drive apparatus. The drive apparatus can comprise an active or passive drive element. The drive element can be a spring or an electric motor.

Figure 3:
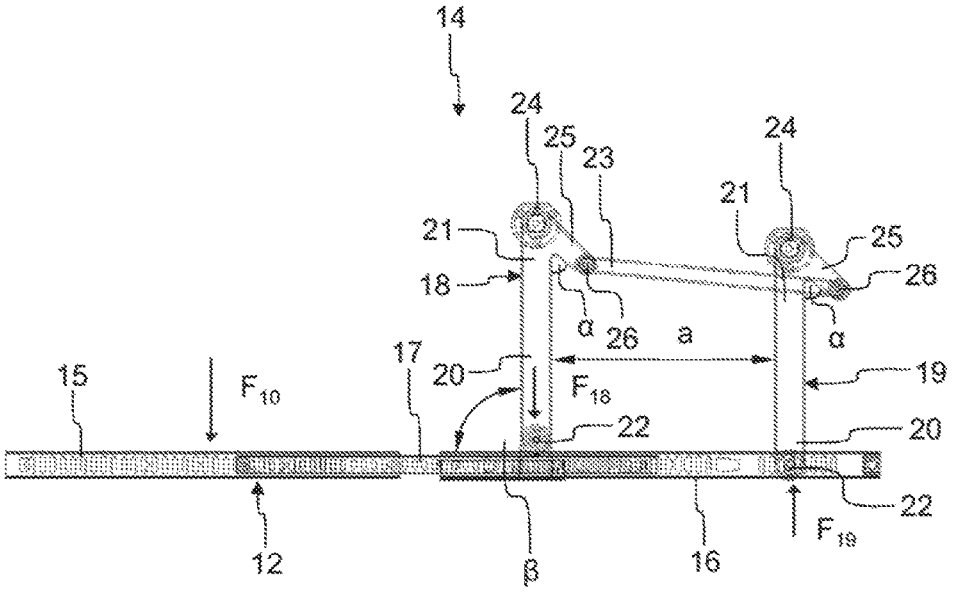
FIG. 3 a schematic side view of an embodiment of a lifting device for the dishwasher according to FIG. 1.
Figure 4:
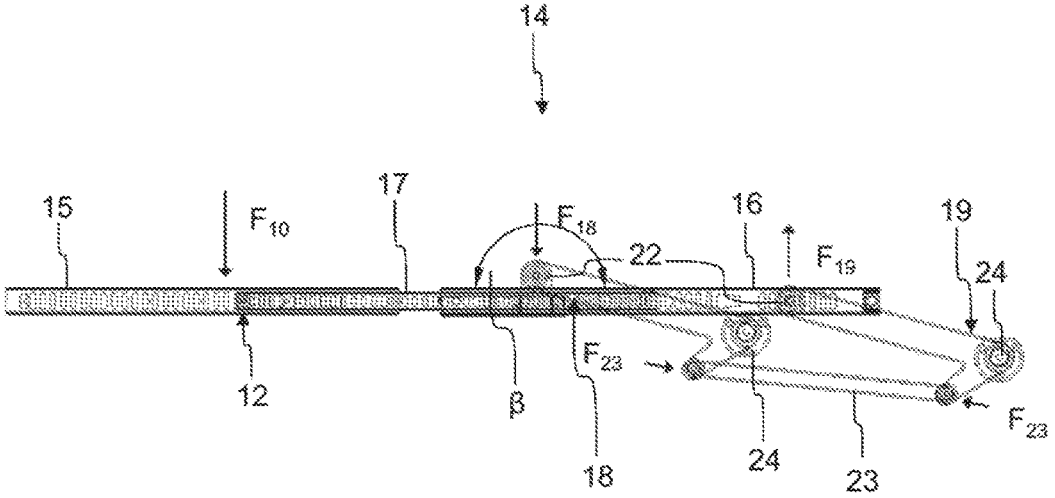
FIG. 4 a further schematic side view of the lifting device according to FIG. 3.

FIG. 3 shows the lifting device 14 in the initial position. FIG. 4 shows the lifting device 14 in the end position. Hereinafter, reference will be made to FIG. 3 and FIG. 4 simultaneously. The holder for items to be washed 10 is not shown in FIG. 3 or FIG. 4. The holder for items to be washed 10 is preferably secured in a removable manner on the guide apparatus 12. The guide apparatus 12 comprises a first guide rail 15 secured to the holder for items to be washed 10, a second guide rail 16 and a third guide rail 17 arranged between the first guide rail 15 and the second guide rail 16. The lifting device 14 comprises the guide apparatus 12. The guide apparatus 12 can be used to guide the holder for items to be washed 10 horizontally. The holder for items to be washed 10 can preferably only be moved into or out of the dishwasher cavity 2 when the holder for items to be washed 10 is in the initial position shown in FIG. 1.

The lifting device 14 further comprises a first swivel arm 18 and a second swivel arm 19. Each swivel arm 18, 19 comprises a second end section 20 and a first end section 21 facing away from the second end section 20. The swivel arms 18, 19 are in particular rod-shaped, strut-shaped or strip-shaped. The second end sections 20 can be used in each case to mount the swivel arms 18, 19 in a swivelable manner on the guide apparatus 12, in particular on the second guide rail 16 of the guide apparatus 12. To this end, a bearing 22 can be provided on each second end section 20. The swivel arms 18, 19 are arranged at a distance a from one another. In the initial position shown in FIG. 3, the swivel arms 18, 19 are arranged vertically and in particular positioned perpendicularly to the guide apparatus 12. In particular, an angle β between the swivel arms 18, 19 and the guide apparatus 12 and in particular the second guide rail 16 is 90°.

The lifting device 14 further comprises a connecting element 23 connecting the first swivel arm 18 and the second swivel arm 19, which is configured to couple a swivel movement of the first swivel arm 18 and a swivel movement of the second swivel arm 19 to one another in a positively driven manner. This means a movement of the first swivel arm 18 is transmitted to the second swivel arm 19 and vice versa by means of the connecting element 23. The connecting element 23 is preferably a strut for the transmission of compressive forces. In particular, the first end sections 21 of the swivel arms 18, 19 are connected to one another by means of the connecting element 23. The first end sections 21 of the swivel arms 18, 19 are also connected to the respective side wall 8, 9 of the dishwasher cavity 2 in a swivelable manner. To this end, the first end sections 21 of the swivel arms 18, 19 can comprise bearings 24, in particular fixed bearings. In this case, the bearing 24 of the second swivel arm 19 is arranged under the bearing 24 of the first swivel arm 18 in the horizontal direction.

The first end section 21 of the first swivel arm 18 and the first end section 21 of the second swivel arm 19 in each case further comprise a lever arm 25, wherein the connecting element 23 connects the lever arms 25 to one another. To this end, bearings 26 can be provided on the lever arms 25. Each lever arm 25 is preferably arranged at an angle of inclination α relative to the swivel arm 18, 19 assigned thereto. In particular, each swivel arm 18, 19 forms a V-shaped or L-shaped geometry with the lever arm 25 assigned thereto. In particular, the two angles of inclination α of the lever arms 25 of the first swivel arm 18 and of the second swivel arm 19 are the same.

The mode of operation of the lever device 14 is explained below. In the extended position shown in FIG. 3 of the guide apparatus 12, the holder for items to be washed 10 applies a weight force $F_{10}$ to the guide apparatus 12 and in particular to the first guide rail 15. The weight force $F_{10}$ acts in the direction of the floor 5 of the dishwasher cavity 2. As a result of the weight force $F_{10}$, a resultant force $F_{19}$ acting opposite to the weight force $F_{10}$ acts on the bearing 22 of the second swivel arm 19 parallel to the second swivel arm 19. Furthermore, a force $F_{18}$ oriented parallel and equal to the weight force $F_{10}$ acts on the bearing 22 of the first swivel arm 18.

When the holder for items to be washed 10 is moved from the initial position shown in FIG. 3 into the end position shown in FIG. 4, the swivel arms 18, 19 swivel about the bearings 24 located on the side walls 8, 9. The swivel arms 18, 19 on the guide apparatus 12 also swivel about the bearings 22. The weight force $F_{10}$ also acts on the first guide rail 15, wherein the force $F_{18}$ acts on the bearing 22 of the first swivel arm 18 and the force $F_{19}$ acts on the bearing 22 of the second swivel arm 19. In addition, the connecting element 23 absorbs thrust forces or transverse forces $F_{23}$ and in this way prevents the bearing 22 of the second swivel arm 19 from buckling upward.

In particular, the stabilization of the lifting device 14 by means of the connecting element 23 enables the bearings 22 of the swivel arms 18, 19 to be moved upward in the vertical direction over the bearings 24 of swivel arms 18, 19 in the direction of the top 4 so that the bearings 22 are arranged above the bearings 24. In particular, the swivel arms 18, 19 can be swiveled to the extent that the angle β is greater than 180°. This means that, when the holder for items to be washed 10 swivels from the initial position into the end position, a swivel angle between the swivel arms 18, 19 and the guide apparatus 12 is greater than 90°. In the end position of the holder for items to be washed 10, this enables a particularly high lifting height of the holder for items to be washed 10 to be achieved. The connecting element 23 also enables the lifting device 14 to be stabilized compared to known approaches.

Although the present invention was described with reference to exemplary embodiments, it can be modified in many ways.

What is claimed is:

1. A lifting device for lifting a holder for items to be washed in a dishwasher from an initial position into an end position, or vice versa, said lifting device comprising:

a guide apparatus configured to guide the holder in a horizontal direction;

a first swivel arm arranged in a swivelable manner on the guide apparatus and having a first end section and a second end section disposed at an opposite end of the first swivel arm with respect to the first end section;

a second swivel arm arranged in a swivelable manner on the guide apparatus and having a first end section and a second end section disposed at an opposite end of the second swivel arm with respect to the first end section of the second swivel arm;

the first end section of the first swivel arm and the first end section of the second swivel arm being connectable in a swivelable manner to a dishwasher cavity in the dishwasher;

said second end sections of the first and the second swivel arms being arranged in a swivelable manner on the guide apparatus; and a connecting element connected in a swivelable manner to the first end section of the first swivel arm and the first end section of the second swivel arm so as to connect the first end section of the first swivel arm and the first end section of the second swivel arm, said connecting element configured to couple a swivel movement of the first swivel arm and a swivel movement of the second swivel arm to one another in a positively driven manner such that a movement of the first swivel arm is transmitted to the second swivel arm and vice versa by the connecting element, wherein the first end section of the first swivel arm and the first end section of the second swivel arm comprise each a lever arm, said connecting element connecting the lever arm of the first end section of the first swivel arm and the lever arm of the first end section of the second swivel arm to one another, and wherein the guide apparatus moves vertically along with the holder as the guide apparatus swivels between the initial position and the end position or vice versa.

2. The lifting device of claim 1, wherein the connecting element is a strut.

3. The lifting device of claim 1, wherein the lever arm of the first end section of the first swivel arm is arranged at an angle of inclination relative to the first swivel arm, and the lever arm of the first end section of the second swivel arm is arranged at an angle of inclination relative to the second swivel arm.

4. The lifting device of claim 1, wherein the first swivel arm forms a V-shaped or L-shaped geometry with the lever arm of the first end section of the first swivel arm, and second swivel arm forms a V-shaped or L-shaped geometry with the lever arm of the first end section of the second swivel arm.

5. A dishwasher, comprising:

a holder for items to be washed; and a lifting device for lifting the holder from an initial position into an end position, or vice versa, said lifting device comprising a guide apparatus configured to guide the holder in a horizontal direction, a first swivel arm arranged in a swivelable manner on the guide apparatus and having a first end section and a second end section disposed at an opposite end of the first swivel arm with respect to the first end section, a second swivel arm arranged in a swivelable manner on the guide apparatus and having a first end section and a second end section disposed at an opposite end of the second swivel arm with respect to the first end section of the second swivel arm, the first end section of the first swivel arm and the first end section of the second swivel arm being connected in a swivelable manner to a dishwasher cavity in the dishwasher; said second end sections of the first and the second swivel arms being arranged in a swivelable manner on the guide apparatus; and a connecting element connected in a swivelable manner to the first end section of the first swivel arm and the first end section of the second swivel arm so as to connect the first end section of the first swivel arm and the first end section of the second swivel arm, said connecting element configured to couple a swivel movement of the first swivel arm and a swivel movement of the second swivel arm to one another in a positively driven manner such that a movement of the first swivel arm is transmitted to the second swivel arm and vice versa by the connecting element, wherein the first end section of the first swivel arm and the first end section of the second swivel arm comprise each a lever arm, said connecting element connecting the lever arm of the first end section of the first swivel arm and the lever arm of the first end section of the second swivel arm to one another, and wherein the guide apparatus moves vertically along with the holder as the guide apparatus swivels between the initial position and the end position or vice versa.

6. The dishwasher of claim 5, wherein the connecting element is a strut.

7. The dishwasher of claim 5, wherein the lever arm of the first end section of the first swivel arm is arranged at an angle of inclination relative to the first swivel arm, and the lever arm of the first end section of the second swivel arm is arranged at an angle of inclination relative to the second swivel arm.

8. The dishwasher of claim 5, wherein the first swivel arm forms a V-shaped or L-shaped geometry with the lever arm of the first end section of the first swivel arm, and second swivel arm forms a V-shaped or L-shaped geometry with the lever arm of the first end section of the second swivel arm.

9. The dishwasher of claim 5, further comprising two of said lifting device, said two lifting devices being arranged on opposite side walls of a dishwasher cavity in the dishwasher.

10. A lifting device for lifting a holder for items to be washed in a dishwasher from an initial position into end position, or vice versa, said lifting device comprising:

a guide apparatus configured to guide the holder in a horizontal direction;

a first swivel arm arranged in a swivelable manner on the guide apparatus and having a first end section and a second end section disposed at an opposite end of the first swivel arm with respect to the first end section;

a second swivel arm arranged in a swivelable manner on the guide apparatus and having a first end section and a second end section disposed at an opposite end of the second swivel arm with respect to the first end section of the second swivel arm;

the first end section of the first swivel arm and the first end section of the second swivel arm being connectable in a swivelable manner to a dishwasher cavity in the dishwasher;

said second end sections of the first and the second swivel arms being arranged in a swivelable manner on the guide apparatus; and a connecting element connected in a swivelable manner of the first end section of the first swivel arm and the first end section of the second swivel arm so as to connect the first end section of the first swivel arm and the first end section of the second swivel arm, said connecting element configured to couple a swivel movement of the first swivel arm and a swivel movement of the second swivel arm to one another in a positively driven manner such that a movement of the first swivel arm is transmitted to the second swivel arm and vice versa by the connecting element, wherein the first end section of the first swivel arm includes a first lever arm and the first end section of the second swivel arm includes a second lever arm, with the connecting element connecting the first lever arm and the second lever arm to one another, and wherein the first swivel arm forms an L-shaped or V-shaped geometry with the first lever arm and the second swivel arm forms an L-shaped or V-shaped geometry with the second lever arm, and wherein the guide apparatus moves vertically along with the holder as the guide apparatus swivels between the initial position and the end position or vice versa.

11. A dishwasher, comprising:

a holder for items to be washed; and a lifting device for lifting the holder from an initial position into an end position, or vice versa, said lifting device comprising a guide apparatus configured to guide the holder in a horizontal direction, a first swivel arm arranged in a swivelable manner on the guide apparatus and having a first end section and a second end section disposed at an opposite end of the first swivel arm with respect to the first end section, a second swivel arm arranged in a swivelable manner on the guide apparatus and having a first end section and a second end section disposed at an opposite end of the second swivel arm with respect to the first end section of the second swivel arm, the first end section of the first swivel arm and the first end section of the second swivel arm being connected in a swivelable manner to a dishwasher cavity in the dishwasher; said second end sections of the first and the second swivel arms being arranged in a swivelable manner on the guide apparatus; and a connecting element connected in a swivelable manner to the first end section of the first swivel arm and the first end section of the second swivel arm so as to connect the first end section of the first swivel arm and the first end section of the second swivel arm, said connecting element configured to couple a swivel movement of the first swivel arm and a swivel movement of the second swivel arm to one another in a positively driven manner such that a movement of the first swivel arm is transmitted to the second swivel arm and vice versa by the connecting element, wherein the first end section of the first swivel arm includes a first lever arm and the first end section of the second swivel arm includes a second lever arm, with the connecting element connecting the first lever arm and the second lever arm to one another, and wherein the first swivel arm forms an L-shaped or V-shaped geometry with the first lever arm and the second swivel arm forms an L-shaped or V-shaped geometry with the second lever arm, and where the guide apparatus moves vertically along with the holder as the guide apparatus swivels between the initial position and the end position or vice versa.

* * * * *